US009842574B2

(12) United States Patent
McFadden et al.

(10) Patent No.: US 9,842,574 B2
(45) Date of Patent: Dec. 12, 2017

(54) COMPRESSIVE CYMBAL MOUNT

(71) Applicants: William Randall McFadden, Redondo Beach, CA (US); Rodney Scott Pino, Harbor City, CA (US)

(72) Inventors: William Randall McFadden, Redondo Beach, CA (US); Rodney Scott Pino, Harbor City, CA (US)

( * ) Notice: Subject to any disclaimer, the term of this patent is extended or adjusted under 35 U.S.C. 154(b) by 0 days.

(21) Appl. No.: 15/412,755

(22) Filed: Jan. 23, 2017

(65) Prior Publication Data

US 2017/0213530 A1 Jul. 27, 2017

Related U.S. Application Data

(60) Provisional application No. 62/281,679, filed on Jan. 21, 2016.

(51) Int. Cl.
*G10D 3/06* (2006.01)
*G10D 13/06* (2006.01)
*G10D 13/02* (2006.01)

(52) U.S. Cl.
CPC ..... *G10D 13/06* (2013.01); *G10D 13/026* (2013.01)

(58) Field of Classification Search
CPC ..... G10D 3/06; G10D 3/026
USPC ..... 84/421
See application file for complete search history.

(56) References Cited

U.S. PATENT DOCUMENTS 2,163,949 A 6/1939 Kiemle
4,114,502 A 9/1978 Lildjian
4,177,709 A 12/1979 Adams
4,185,808 A 1/1980 Donohoe et al.
4,208,942 A 6/1980 Henrit
4,248,129 A 2/1981 Zildjian
4,262,576 A 4/1981 Gorsky et al.
4,274,322 A 6/1981 Cordes
D262,073 S 12/1981 Zimmerman
4,319,514 A 3/1982 Donohoe
4,365,535 A 12/1982 Buttner et al.
4,381,690 A 5/1983 Kimble
4,402,248 A 9/1983 Pearce
4,458,574 A 7/1984 Hoshino
(Continued)

OTHER PUBLICATIONS

International Search Report and Written Opinion issued in PCT/US2017/014559, dated Apr. 6, 2017.

*Primary Examiner* — David Warren
(74) *Attorney, Agent, or Firm* — Heslin Rothenberg Farley & Mesiti, P.C.; Kristian E. Ziegler

(57) ABSTRACT

Cymbal mounting apparatuses, systems and methods are provided. In one embodiment, a cymbal mounting apparatus for mounting a cymbal to a mounting post of a cymbal stand is provided. The apparatus comprises a cymbal mount that comprises an elongated flexible sleeve portion defining an inner cavity with a second diameter that is less than a first diameter of the mounting post such that the sleeve portion applies a compressive force thereto when installed thereon. The cymbal mount further comprises a cymbal support rim portion extend outwardly from the sleeve portion. The sleeve portion and the rim portion may be integral. The mounting post may define a first length extending between a shoulder portion and a free end thereof, and the sleeve portion may define a second length that is at least one half the first length such that the sleeve portions extends past the free end when installed thereon.

20 Claims, 11 Drawing Sheets

(56) References Cited

U.S. PATENT DOCUMENTS 4,479,414 A 10/1984 Willis
4,510,838 A 4/1985 Alexis, Jr.
4,517,876 A 5/1985 Duhon
4,520,710 A 6/1985 Elliott, Jr.
4,606,525 A 8/1986 Lombardi
4,666,110 A 5/1987 Prouty
4,889,028 A 12/1989 Lombardi
4,889,303 A 12/1989 Wolf
4,960,028 A * 10/1990 Ramirez ..... G10D 13/06 84/421
4,987,817 A 1/1991 Diaz
5,052,262 A 10/1991 Havens
5,063,819 A 11/1991 Hoshino
5,088,377 A 2/1992 Delecaris
5,121,665 A 6/1992 Myers et al.
5,165,552 A 11/1992 Muhlbauer
5,218,151 A 6/1993 Kurosaki
D338,484 S 8/1993 Richfield
5,415,072 A 5/1995 Huang
5,566,911 A 10/1996 Hoshino
5,639,976 A 6/1997 Manoff et al.
5,691,492 A 11/1997 May
5,739,447 A 4/1998 Hoshino
D399,867 S 10/1998 Hsieh
5,836,561 A 11/1998 Liao
5,936,176 A 8/1999 Lombardi
5,959,227 A 9/1999 Shapiro
5,965,834 A 10/1999 Suenaga et al.
5,969,281 A 10/1999 Suenaga
5,990,400 A 11/1999 Hoshino
6,028,257 A 2/2000 May
6,034,313 A 3/2000 Shelley
6,054,645 A 4/2000 Gauger
6,057,500 A 5/2000 Liao
6,093,878 A 7/2000 Hoshino
6,239,343 B1 5/2001 Hoshino
6,245,980 B1 6/2001 May
6,259,011 B1 7/2001 Liao
6,310,277 B1 10/2001 Shelley
6,320,109 B1 11/2001 Kuppers
6,417,434 B1 7/2002 Lao
6,437,225 B1 8/2002 Shigenaga
6,448,482 B2 9/2002 Cerro
6,485,037 B1 11/2002 Sulcer, Jr.
6,822,150 B1 11/2004 Lombardi
6,838,602 B2 1/2005 Chang
6,930,233 B2 8/2005 Hsieh
7,034,216 B2 4/2006 DiPietro
7,045,697 B2 5/2006 Covello et al.
7,078,606 B2 7/2006 Tanaka
7,115,805 B1 10/2006 Vandervoort
7,119,264 B2 10/2006 Van Dyk
7,157,636 B2 1/2007 Hsieh
7,323,632 B2 1/2008 Wachter
7,329,810 B2 2/2008 Spivack et al.
7,395,994 B1 7/2008 Sikra
7,468,483 B2 12/2008 Yoshino
7,479,593 B1 1/2009 Townsend
7,601,903 B1 10/2009 Monk
7,626,107 B1 12/2009 Takegawa
7,629,526 B1 12/2009 Miyajima
7,915,507 B2 3/2011 Onheiser
7,928,302 B2 4/2011 Sandson
8,153,877 B2 4/2012 Coady
8,198,522 B2 6/2012 Michael
8,237,039 B2 * 8/2012 Crelin ..... F16B 9/026 84/422.1
8,269,088 B1 9/2012 Liao
8,288,639 B2 10/2012 Carraro
8,294,014 B2 10/2012 Voorhees
8,330,031 B2 12/2012 Taninbaum
8,334,448 B2 12/2012 Onheiser
8,338,682 B1 12/2012 Sikra
8,476,515 B2 7/2013 Coady
8,692,098 B1 4/2014 Reinhard
8,697,970 B2 4/2014 Harrison et al.
8,729,378 B2 5/2014 Ryan et al.
8,865,988 B2 * 10/2014 Nakata ..... G10D 13/06 84/422.3
8,940,994 B2 1/2015 Truchsess
8,946,531 B2 2/2015 Nakata et al.
8,969,696 B2 3/2015 Wiley et al.
9,070,348 B2 6/2015 Takegawa
9,076,415 B2 7/2015 Allen
9,165,544 B2 10/2015 Yoshino
9,208,761 B2 12/2015 Miyajima
2008/0127805 A1 * 6/2008 Onheiser ..... G10D 13/06 84/421
2008/0179266 A1 * 7/2008 Mori ..... G10D 13/026 211/85.6
2014/0033895 A1 * 2/2014 Wiley ..... G10D 13/026 84/421
2015/0170623 A1 * 6/2015 Wiley ..... G10D 13/026 84/421
2017/0076703 A1 * 3/2017 Miyata ..... G10D 13/026
2017/0213530 A1 * 7/2017 McFadden ..... G10D 13/06

* cited by examiner

COMPRESSIVE CYMBAL MOUNT

CROSS-REFERENCE TO RELATED APPLICATION

This application perfects and claims the benefit of U.S. Provisional Patent Application No. 62/281,679, filed on Jan. 21, 2016, and entitled Cymbal Mount, which is hereby expressively incorporated herein by reference in its entirety.

FIELD OF THE DISCLOSURE

The present disclosure generally relates to mounts for cymbals, and more particularly to mounts for cymbals that mount a cymbal onto a mounting post of a cymbal stand.

BACKGROUND

Cymbals are a common percussion instrument played by a drummer. Cymbals typically consist of thin, normally round, thin plates of various metal alloys. The majority of cymbals are of indefinite pitch, but some designs sound a definite note. Cymbals are used in many ensembles ranging from orchestra, percussion ensembles, jazz bands, heavy metal bands, marching groups and other situations. For mounting purposes, most cymbals include a central circular mounting aperture that extends though the cymbals.

In use, cymbals are commonly mounted onto, and supported by, a cymbal stand via their mounting aperture. Some cymbal stands have legs which rest on the ground and a cymbal support shaft which extends upwardly therefrom. In some stands the support shaft extends substantially vertically, and in some other stands the support shaft extends angularly as a boom arm to position the cymbal closer to the drummer than the legs. Cymbal stands also typically include a mounting post or tilter peg that form a free end of the support shaft onto which a cymbal is mounted and coupled to. Many times the mounting post is vertically oriented, but may it may be orientated in any orientation. For example, a movable joint or "tilter" may orient or angle a mounting post with respect to a support shaft.

Mounting posts of typical cymbal stands include a cylindrical portion and a shoulder portion that defines a larger diameter or width than the cylindrical portion. In such embodiments, the cylindrical portion extends from the shoulder portion and defines a free end. The cylindrical portion also typically includes an externally threaded portion and a non-threaded portion extending between the shoulder portion and the externally threaded portion. The cylindrical portion of these mounting posts is sized to extend through the mounting aperture of a cymbal so the cymbal can be mounted or coupled to the thereto and thus supported by the cymbal stand.

More specifically, one conventional method of mounting a cymbal onto a cymbal stand that includes such a mounting post is to initially pass a first rigid washer over the cylindrical portion until it is rests on the shoulder portion (i.e., pass the first rigid washer over the mounting post past the threaded and onto non-threaded portion adjacent the shoulder portion). Once the first washer is in place resting on the shoulder portion, a cylindrical plastic sleeve is loosely slid over the cylindrical portion until it is rests on or is adjacent to the first washer. The cylindrical plastic sleeve may extend over the non-threaded-portion and potentially a portion of the threaded portion. A relatively thick first felt washer is then passed over the cylindrical portion and slipped over the plastic sleeve so that is sits on the first metal washer. The cymbal is then placed on the mounting post such that the mounting post extends through the mounting aperture and the cymbal rests on the first felt washer. The cylindrical plastic sleeve may also extend through the mounting aperture of the cymbal to protect the cymbal from the mounting post. A second relatively thick felt washer is then placed over the mounting post and on the cymbal, often followed by a second metal washer that sits of the second felt washer. Lastly, a wing nut or other internally threaded member is screwed down on the threaded portion and into abutment with the second metal washer to lock and/or clamp the cymbal onto the cymbal stand between the first and second felt washers and to prevent the cymbal from dismounting from the stand during a use of the cymbal. While a wing nut is the most typical member for locking down the cymbal or preventing the cymbal from dismounting from the stand during use of the cymbal, there are other mechanisms in use today. These types of mechanisms will be referred to herein as "affixing mechanisms." Affixing mechanisms include, but are not limited to, threaded components, metal press clips, and spring loaded retention features. Typical affixing mechanisms currently employed are located above the cymbal after it has been placed on the stand over the mounting post.

Current methods and mechanisms currently used to mount cymbals to stands, such as to mounting posts thereof, have several disadvantages. For example, current mounting methods and systems are time consuming. Multiple component mounting systems take significant time to properly mount and affix each cymbal onto each stand. It also is time consuming to detach each mounted cymbal and properly store all the mounting components when tearing down each mounted cymbal after use. Because of the small nature of the many loose and separate parts involved of current mounting systems, parts frequently get misplaced, lost or stolen. Still further, components of current mounting systems are prone to breakage due to restriction or clamping against the cymbal, as well as from drum stick impact, for example.

Even further, while current mounting systems may provide some protection of the cymbal, they include components made from rigid plastics and metals. These rigid components of current mounting systems are typically located under and over the mounting aperture of the cymbal and, regardless of placement of the felt washers for example, frequently damage the cymbal resulting in failure of the cymbal to produce its intended sound(s). For example, the rigid components of current mounting systems often cause cracks or ruptures in the body of the cymbal adjacent its mounting aperture. These rigid components can also damage a drum stick if the drums stick strikes the components. Still further, the rigid components themselves often chip, crack or otherwise break from repetitive stress and/or drum stick strikes.

Yet another disadvantage of current mounting systems and methods is that they negatively impact the sound quality a mounted cymbal. As discussed above, many current mounting systems essentially sandwich a cymbal between rigid materials (e.g., rigid washers and/or a rigid washer and a shoulder portion of a mounting post) regardless of any soft members (e.g., felt washers) used in the mounting systems. Although some systems utilize soft members tightly sandwiched in the local area at the mounting aperture of the cymbal, they do not effectively dissipate the force stresses experienced by the cymbal from repeated impacts on the outside edge of the cymbal, for example. Further, existing mounting systems dampen the natural vibration of a cymbal, impact tonal quality and reduce the overall length of cymbal vibrational sound output after being struck. As noted above, the systems also often lead to cymbal damage which significantly impacts sound quality.

The present disclosure provides improved cymbal mounting apparatuses, systems and methods that overcome one or more of these disadvantages of the state of the art.

While certain aspects of conventional technologies have been discussed to facilitate disclosure, Applicant in no way disclaims these technical aspects, and it is contemplated that the claimed inventions may encompass one or more conventional technical aspects.

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY

Briefly, the present disclosure satisfies the need for improved cymbal mounting apparatuses, systems and methods that may address one or more of the problems and deficiencies of the art discussed above. However, it is contemplated that the present disclosure may prove useful in addressing other problems and deficiencies in a number of technical areas. Therefore, the claimed inventions and present disclosure should not necessarily be construed as limited to addressing any of the particular problems or deficiencies discussed herein.

In a first aspect, the present disclosure provides a cymbal mounting apparatus for mounting a cymbal to a mounting post of a cymbal stand. The cymbal mounting apparatus comprises a cymbal mount. The cymbal mount comprises an elongated flexible sleeve portion defining an inner cavity with a second diameter that is less than a first diameter of the mounting post of the cymbal stand such that the sleeve portion applies a compressive force to the mounting post when installed thereon. The cymbal mount further comprises a cymbal support rim portion extend outwardly from the sleeve portion.

In some embodiments, the sleeve portion and the rim portion are integral. In some embodiments, the cymbal mount is elastomeric. In some embodiments, the mounting post and the cavity of the sleeve portion are cylindrical, and wherein cavity extends axially through the sleeve portion. In some embodiments, the sleeve portion is cylindrical, and wherein the rim portion extends circumferentially about and radially outwardly from the sleeve portion. In some embodiments, the rim portion defines a third diameter of about 1.5 inches.

In some embodiments, the cavity of the sleeve portion is non-threaded. In some embodiments, at least a portion of the cavity of the sleeve portion is threaded. In some embodiments, the second diameter of the cavity of the sleeve portion is about 10% undersized of the first diameter of the mounting post. In some embodiments, the second diameter of the cavity of the sleeve portion is about 7.1 mm.

In some embodiments, the mounting post defines a first length extending between a shoulder portion and a free end thereof, and wherein the sleeve portion defines a second length that is at least one half the first length. In some such embodiments, the second length of the sleeve portion is greater than the first length of the mounting post. In some embodiments, the sleeve portion defines an axial length of about 2.5 inches. In some embodiments, the cymbal defines a mounting aperture of a fourth diameter, and wherein the sleeve portion is cylindrical and the exterior surface thereof defines a fifth diameter that is less than the fourth diameter. In some embodiments, the sleeve portion is cylindrical and the exterior surface thereof defines a diameter of about 10 mm.

In some embodiments, the cymbal mounting apparatus further comprises a washer configured to be positioned on an upper surface of the support rim and extend at least partially about the sleeve portion. In some embodiments, the cymbal mount further comprises a liner portion extending from an upper portion of the rim portion about at least a portion of the sleeve portion, wherein the liner portion is more flexible than at least the rim portion.

In another aspect, the present disclosure provides a cymbal stand for supporting a cymbal. The cymbal stand comprises a support arm including a mounting post defining a free end and a first diameter. The cymbal stand further comprises a cymbal mount that comprises an elongated flexible sleeve portion defining an inner cavity with a second diameter that is less than the first diameter of the mounting post such that the sleeve portion applies a compressive force to the mounting post. The cymbal mount further comprises a cymbal support rim portion extending outwardly from the sleeve portion.

In some embodiments, the cymbal mount is of one-piece construction. In some embodiments, the sleeve portion of the cymbal mount extends past the free end of the mounting post.

Certain embodiments of the presently-disclosed cymbal mounting apparatuses, systems and methods have several features, no single one of which is solely responsible for their desirable attributes. Without limiting the scope of the cymbal mounting apparatuses, systems and methods as defined by the claims that follow, their more prominent features will now be discussed briefly. After considering this discussion, and particularly after reading the section of this specification entitled "Detailed Description," one will understand how the features of the various embodiments disclosed herein provide a number of advantages over the current state of the art.

These and other features and advantages of the present disclosure will become apparent from the following detailed description of the various aspects of the present disclosure taken in conjunction with the appended claims and the accompanying drawings.

BRIEF DESCRIPTION OF THE DRAWINGS

The present disclosure will hereinafter be described in conjunction with the following drawing figures, wherein like numerals denote like elements, aspects or features, and.

DETAILED DESCRIPTION OF THE INVENTION

Figure 1:
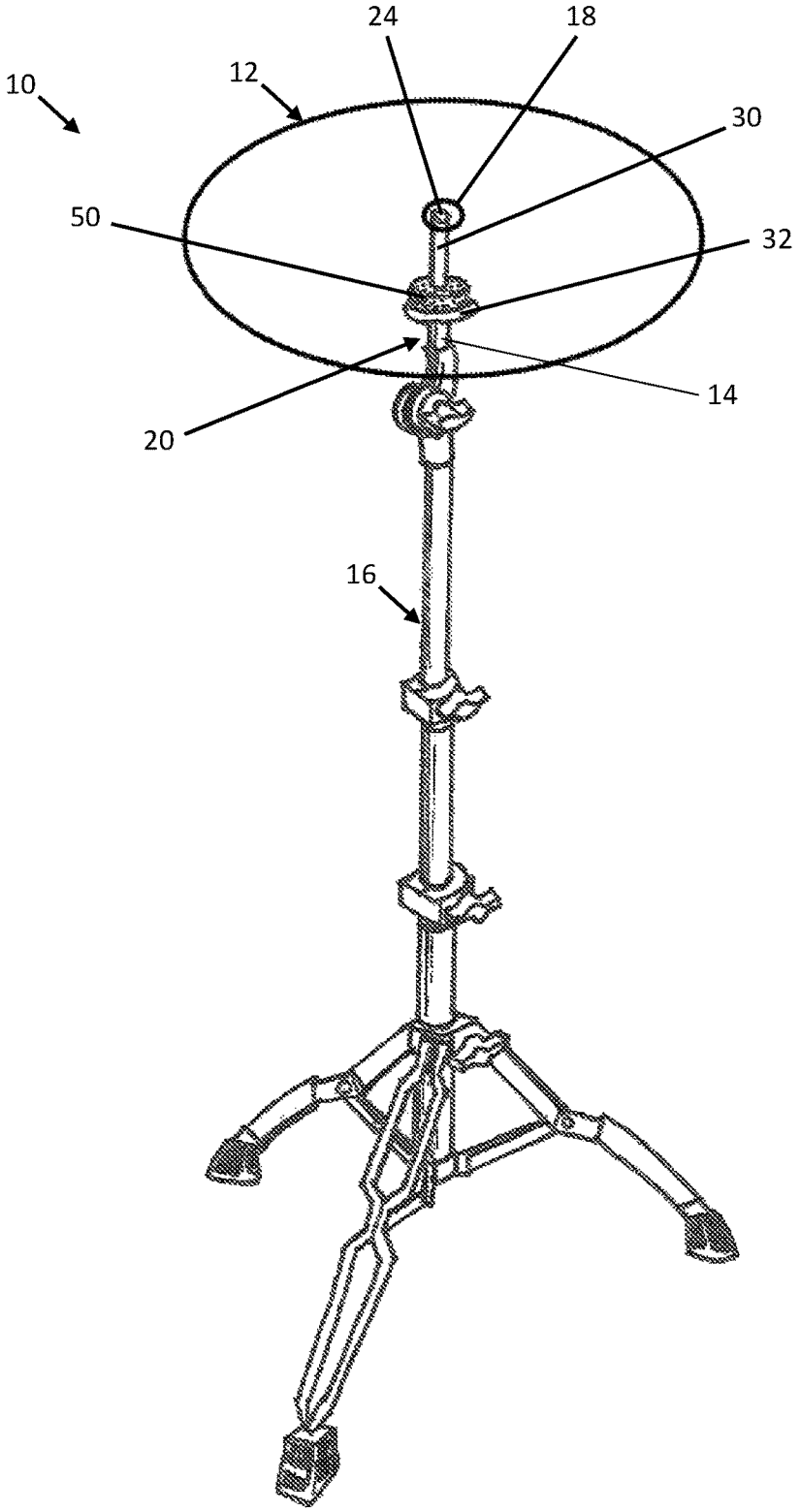
FIG. 1 is an elevational perspective view illustrating an exemplary cymbal being mounted onto an exemplary cymbal stand that includes an exemplary cymbal mounting apparatus according to the present disclosure.

Aspects of the present disclosure and certain features, advantages, and details thereof are explained more fully below with reference to the non-limiting embodiments illustrated in the accompanying drawings. Descriptions of well-known materials, fabrication tools, processing techniques, etc., are omitted so as to not unnecessarily obscure the present disclosure in detail. It should be understood, however, that the detailed description and the specific example (s), while indicating embodiments of the present disclosure, are given by way of illustration only, and are not by way of limitation. Various substitutions, modifications, additions and/or arrangements within the spirit and/or scope of the underlying inventive concepts will be apparent to those skilled in the art from this disclosure.

The present disclosure provides cymbal mounting apparatuses, systems and related methods for mounting a cymbal to a mounting post of a cymbal stand. The cymbal mounting apparatuses, systems and related methods make use of a cymbal mount. The cymbal mount may be a single unitary component (i.e., of one-piece construction). In some embodiments, the cymbal mounting apparatuses, systems and related methods make use of a cymbal mount and at least one washer, such as a single felt washer.

The cymbal mount of the present disclosure may be a single component molded out of a flexible, yet durable polymeric material. The cymbal mount may define or include a cavity with a diameter specifically designed to squeeze fit over a support post of a support arm of a cymbal stand (i.e., apply a compressive force thereto). The cymbal mount may also include or define a length specifically designed to extend a minimum distance beyond a free end or top of the mounting post. The squeeze fit feature and the extended length feature may combine to prevent a cymbal from dismounting from the cymbal mount and the cymbal stand during use.

In some embodiment, the cymbal mount may mount a cymbal on a threaded end of a mounting post of a cymbal stand that locates, supports and maintains the cymbal on the cymbal stand throughout use. The cymbal mount may be a single component, such as made from an elastomeric material, with a sleeve portion and an outwardly projecting rim portion at one end of the sleeve portion. The sleeve portion may be configured to be press fit over the free end of the mounting post such that the sleeve portion extends at least over a threaded portion of the mounting post. The cavity may include or define a diameter that is slightly smaller than a diameter of the mounting post to affix the sleeve portion to the mounting post, such as for the life of the cymbal mount. The sleeve portion may extend above or beyond the free end of the mounting post when seated on the mounting post, such as when partially and/or fully seated on the mounting post. A cymbal may be placed directly over the sleeve portion via a mount aperture of the cymbal such that the cymbal rests on the on the rim portion. In one embodiment, if desired, a washer, such as a circular felt washer, may be slipped over the sleeve portion and be seated on the rim portion so that the cymbal rests on the washer. In another embodiment, the cymbal mount may include a liner portion extending from an upper portion of the rim portion about at least a portion of the sleeve portion. The liner portion may be more flexible than at least the rim portion. For example, the liner portion may be a softer material, such as a softer more flexible elastomer material, as compared to the material of the rim portion and/or the sleeve portion.

The compressive or squeeze fit feature of the sleeve portion of the cymbal mount may allow for the cymbal mount to remain attached to the cymbal permanently, thereby eliminating the need to tear down and set up a mounting system for each performance or use and preventing loss of components from handling and storage. The flexible nature of the cymbal mount (e.g., due to its elastomeric composition), in on embodiment, may protect a cymbal installed thereon against cracking and breakage, and thereby extend cymbal life and eliminate unwanted background noises from movement of the cymbal against the hard rigid materials used in conventional mounting systems. The flexible nature (e.g., elastomeric composition) of the cymbal mount may also absorb drum stick strikes, and thereby prevent drum stick damage as well as damage that typically occurs to rigid components in conventional mounting systems.

The extended sleeve length of the cymbal mount, in some embodiments, may eliminate the need for an affixing mechanism above the cymbal, eliminate unwanted noise from striking the affixing mechanism above the cymbal, and allow the cymbal to ring freely without vibration dampening. Due to the extended length of the sleeve, a cymbal may be prevented from dismounting from the stand/mount during use or play, and therefore there is no need for any additional parts to secure the cymbal to the cymbal stand or to protect the cymbal from a mechanical locking mechanism.

As noted above, cymbal mount may include a liner portion extending from an upper portion of the rim portion about at least a portion of the sleeve portion. The liner portion may be more flexible than at least the rim portion. For example, the liner portion may be a softer material, such as a softer more flexible elastomer material, as compared to the material of the rim portion and/or the sleeve portion. In some embodiments, the liner portion may be an integral soft segment over-molded onto the elastomeric support rim portion and/or the elastomeric sleeve portion to eliminate any need for a washer for resting the cymbal on the mount, if desired. In such an embodiment, the cymbal mount may thereby be a single unitary component solution that remains attached to a cymbal stand and/or support post for the life of the elastomeric cymbal mount.

Figure 2:
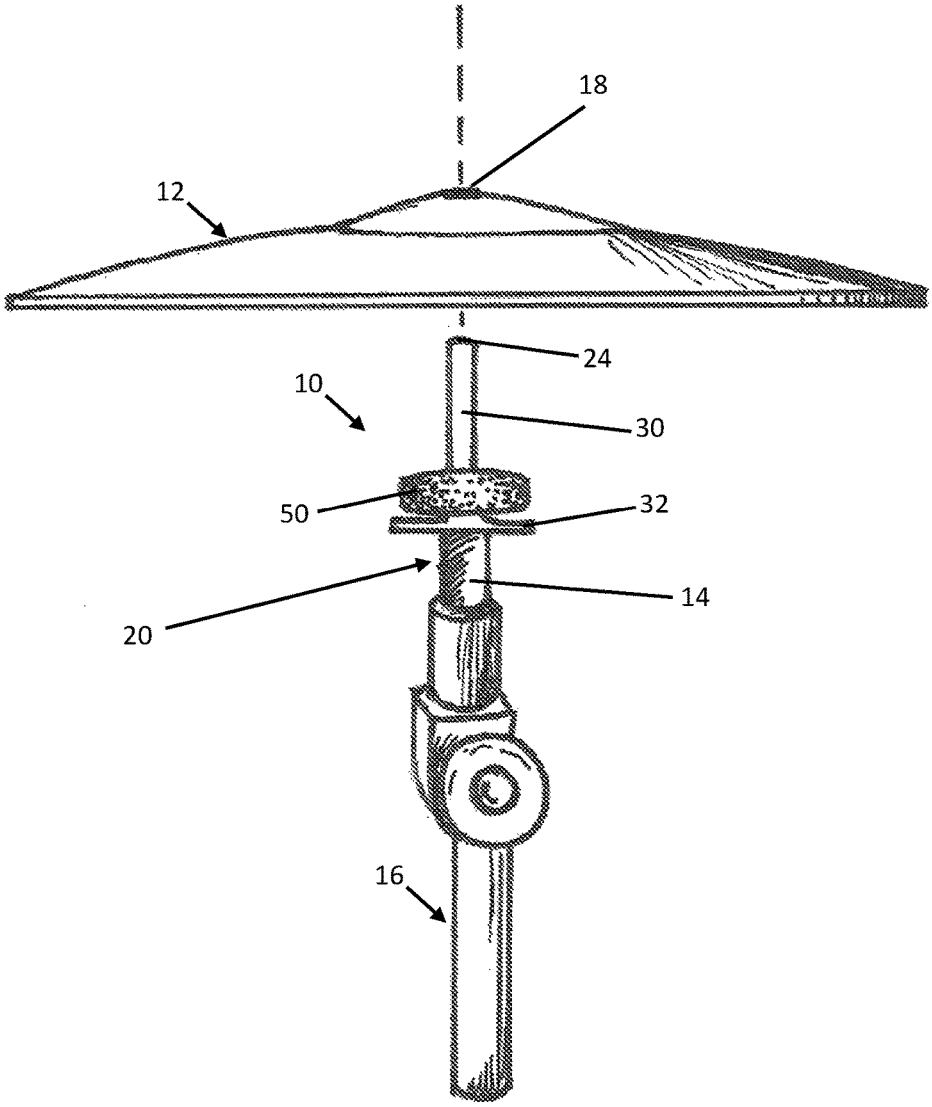
FIG. 2 is an elevational perspective view illustrating the cymbal being mounted onto the cymbal mounting apparatus of FIG. 1.
Figure 3:
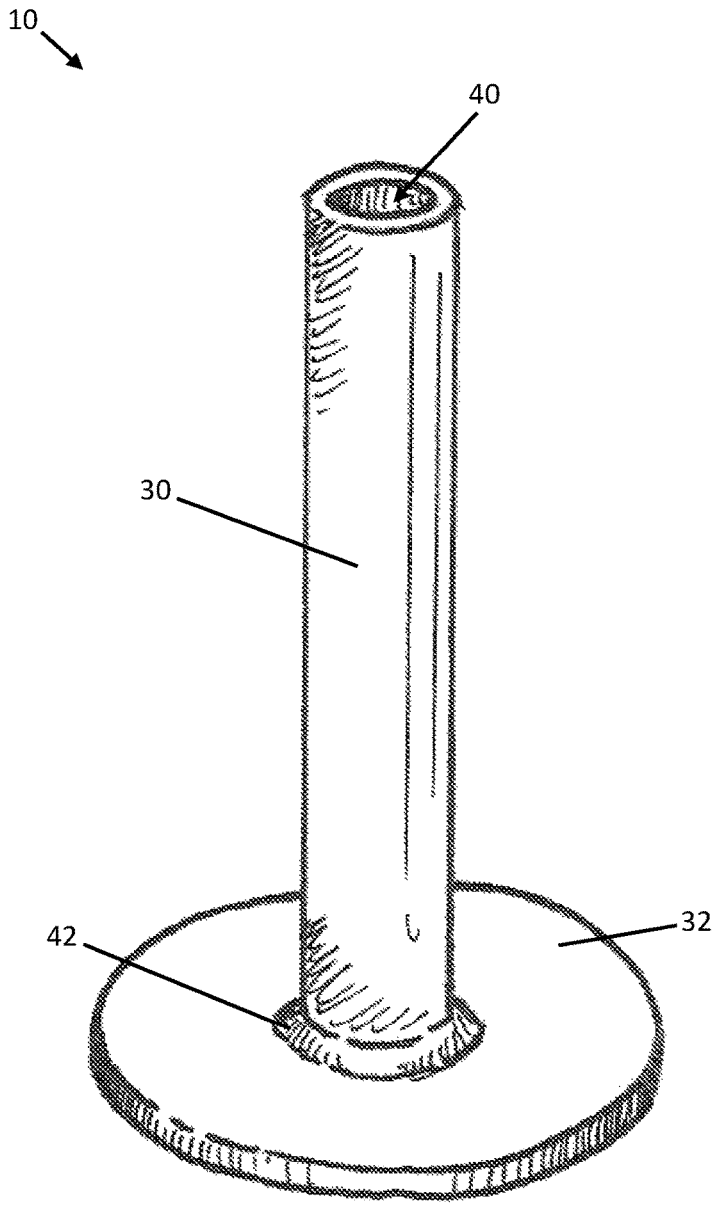
FIG. 3 is an elevational perspective view of an exemplary cymbal mount of the cymbal mounting apparatus of FIG. 1.
Figure 4:
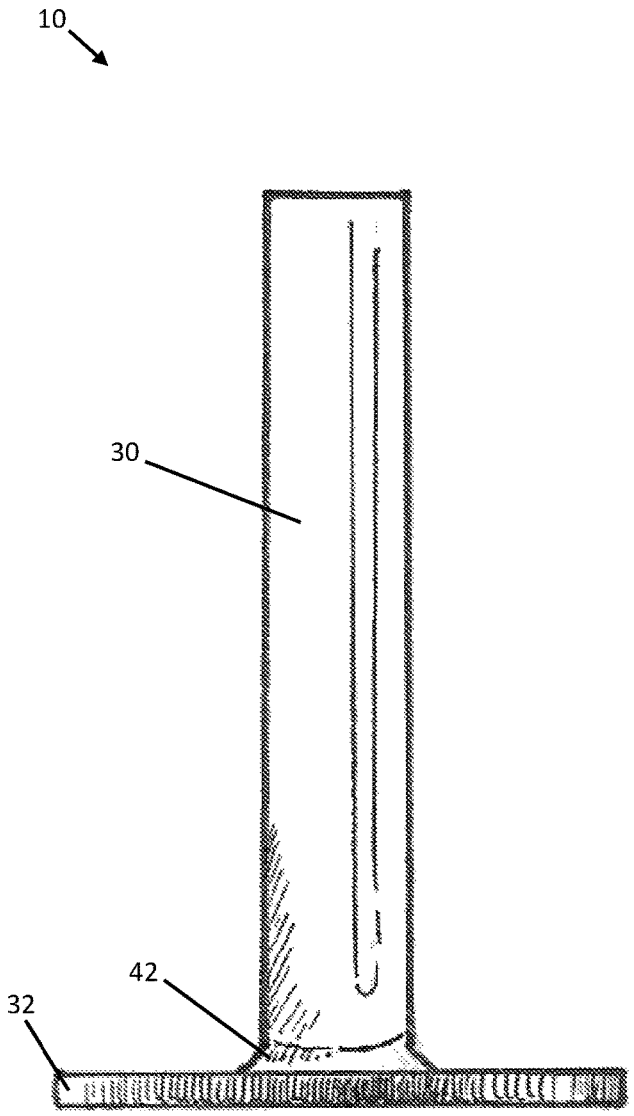
FIG. 4 is a side view of the cymbal mount of FIG. 3.

As shown in FIGS. 1 and 2, in some embodiments the cymbal mounting apparatuses, systems and related methods of may include a cymbal mount 10 for mounting a cymbal 12 to a mounting post 14 of a cymbal stand 16. However, it will be understood that the mount 10 could be used to mount any other suitable percussive instrument onto a stand 16. Further, the stand 16 may be any stand of any configuration or design. For example, the cymbal 12 and the stand 16 may be conventional items. As shown in FIG. 1, the cymbal 16 may include a circular mounting aperture 18 in the center of the cymbal. So that a cymbal 16 can mount to the mounting post 14, the mounting post 14 may be a cylindrical portion at the top end of the cymbal stand 16 configured to extend through the aperture 18.

Figure 7:
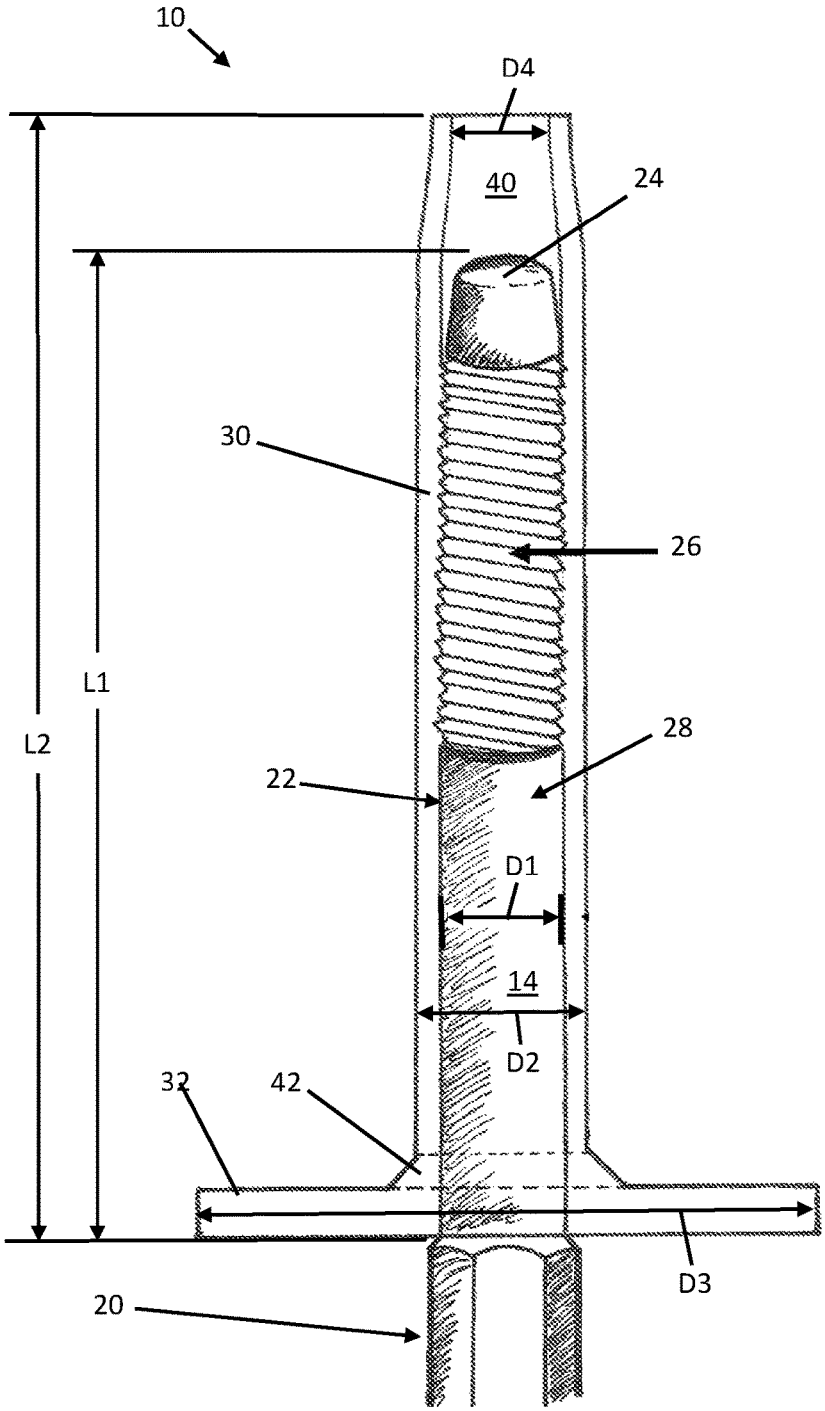
FIG. 7 is a cross-sectional view of the cymbal mount of FIG. 3 installed on an exemplary mounting post of an exemplary cymbal stand.
Figure 8:
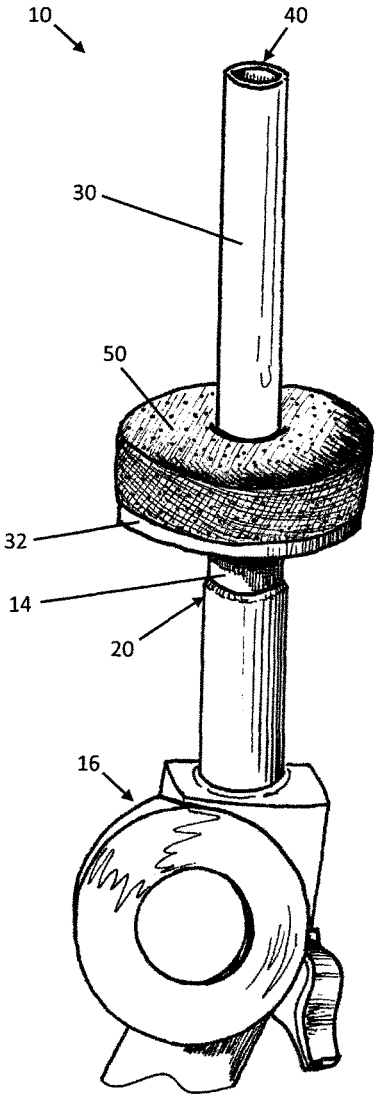
FIG. 8 is an elevational perspective view of the exemplary cymbal mounting apparatus and exemplary mounting post of FIG. 1.
Figure 9:
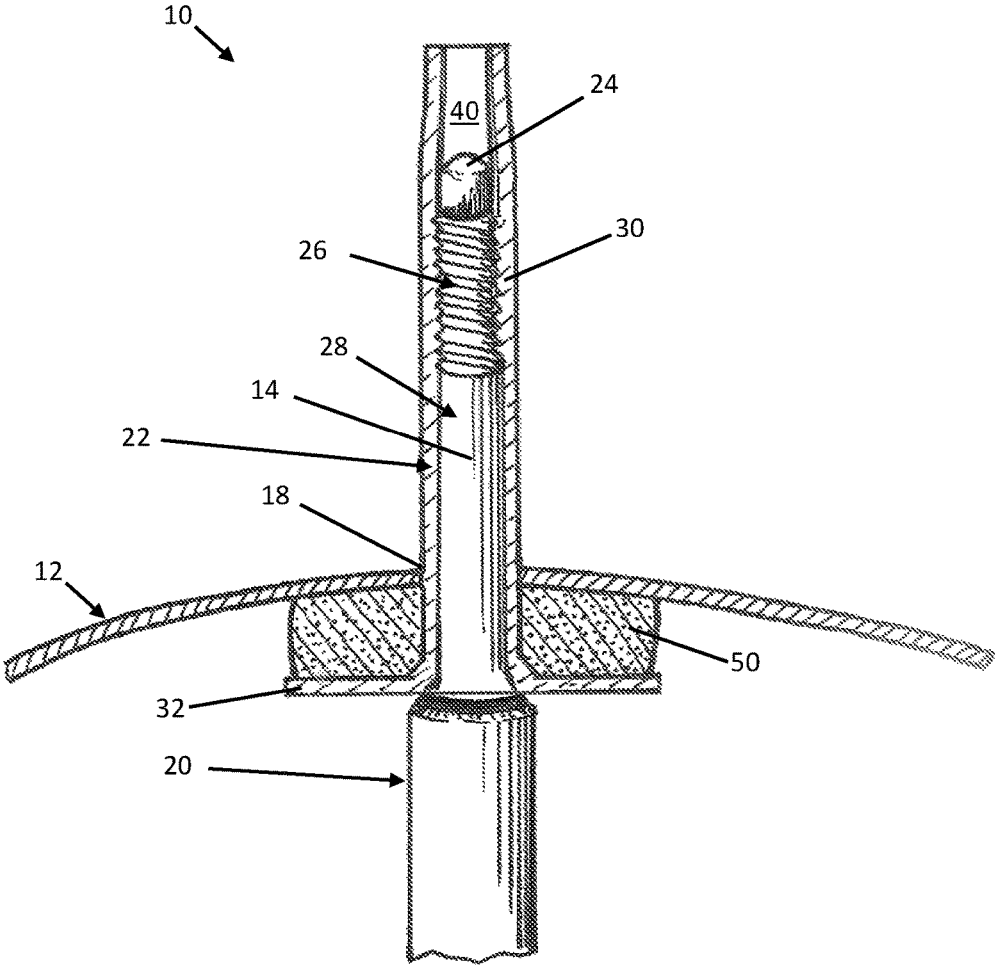
FIG. 9 is a cross-sectional view of the cymbal mounting apparatus and the mounting post of FIG. 8 mounting an exemplary cymbal.

As shown in FIGS. 2 and 7-9, the mounting post 14 may include a shoulder portion 20. As shown in FIGS. 7 and 9, the mounting post 14 may include a cylindrical connecting portion 22 extending from the shoulder portion 20 that defines a free end or top 24. As also shown in FIGS. 7 and 9, the cylindrical portion 22 may include a threaded portion 26 proximate to the free end 24, and a non-threaded portion 28 proximate to the shoulder portion 20. However, other mounting post 14 may be configured differently, such as not including the shoulder portion 20, not including the non-threaded portion 28, including multiple non-threaded portions 28 and/or threaded portions 26, etc.

As shown in FIG. 7 the cylindrical connecting portion 22 of the mounting post 14 may define a diameter D1. The diameter D1 may be any size. In some embodiments, the diameter D1 of the cylindrical portion 22 of the mounting post 14 may be within the range of 6-9 mm. In the exemplary illustrative embodiment, the diameter D1 of the cylindrical portion 22 of the mounting post 14 is about 8 mm. As also shown in FIG. 7, the cylindrical portion 22 of the mounting post 14 may define an axial length L1 measured from the upper edge or end of the shoulder portion 20 to the free end 24. The axial length L1 may be any length. In the exemplary illustrative embodiment, the length L1 of the cylindrical portion 22 of the mounting post 14 is about 2 inches.

As shown in FIGS. 1-10, the cymbal mount 10 may include an elongated flexible sleeve portion 30 and a cymbal support rim portion 32 extending outwardly from the sleeve portion 30. As shown in FIGS. 1-10, the sleeve portion 30 of the mount 10 may be cylindrical, and the rim portion 32 may extend circumferentially about and radially outwardly from the sleeve portion. The exterior surface of the sleeve portion 30 may define a diameter D2. The diameter D2 of the exterior surface of the sleeve portion 30 may be any size. In some embodiments, the diameter D2 of the exterior surface of the sleeve portion 30 may be smaller than the diameter of the mounting aperture 18 of a cymbal 12. For example, in embodiments wherein the diameter of the mounting aperture 18 of a cymbal 12 is 7/16 inch or 11 mm, the diameter D2 of the exterior surface of the sleeve portion 30 may be 10 mm. The diameter D2 of the exterior surface of the sleeve portion 30 being smaller than the diameter of the mounting aperture 18 of a cymbal 12 may allow the cymbal 12 freely swing during use (a thick diameter, which may be utilized, could impede the swinging motion of the cymbal 12 leading to premature breakage thereof).

As shown in FIGS. 1-10, the rim portion 32 may extend circumferentially about and radially outwardly from a lower end or portion of the sleeve portion 30. The outwardly projecting rim portion 32 may have sufficient rigidity for the cymbal 12 to be supported thereon with minimal deflection of the rim portion 32. The rim portion 32 may define an outer diameter D3. The diameter D3 of the rim portion 32 may be any size. In some embodiments, the diameter D3 of the rim portion 32 may be within the range of 3 inches to ½ inch. In the exemplary illustrative embodiment, the diameter D3 of the rim portion 32 of the cymbal mount 10 is about 1.5 inches. In some embodiments, the portion 32 of the cymbal mount 10 may be at least about 3 mm thick. In some embodiments, the portion 32 of the cymbal mount 10 may be within the range of about 3-7 mm thick. In some embodiments, the portion 32 of the cymbal mount 10 may about 3 mm thick, or about 6 mm thick. As noted above, the rim portion 32 (and/or the sleeve portion 30) may be made from an elastomer.

As shown in FIGS. 3-7, the sleeve portion 30 and the rim portion 32 of the cymbal mount 10 may be integral. In some embodiments, the cymbal mount 10 may be of one-piece construction or a unitary single component. The sleeve portion 30 may be cylindrical and the rim portion 32 may be a circular disc shape. The sleeve portion 30 and the rim portion 32 may be aligned along a common axis. In this way, the top or upper surface of the rim portion 32 may be oriented 90 degrees to the exterior surface of the sleeve portion 30. The rim portion 32 may extend outwardly from the sleeve portion 30.

As shown in FIGS. 3, 5A-7 and 9, the sleeve portion 30 may define or include an inner cavity 40 with a fourth diameter D4. In some embodiments, cavity 40 may extend axially through the sleeve portion 30 and the rim portion 32, as shown in FIGS. 5A-7. In some embodiments, the connecting portion 22 of the mounting post 14 and the cavity 40 of the sleeve portion 30 may be cylindrical. As noted above, the inner cavity 40 may define or include a fourth diameter D4. As shown in FIGS. 7 and 9, the fourth diameter D4 of the inner cavity 40 may be less than the first diameter D1 of the connecting portion 22 (e.g., cylindrical connecting portion 22) of the mounting post 14 of the mount 10 so that the sleeve portion 30 applies a compressive force to the mounting post 14 when installed thereon. In some embodiments, the fourth diameter D4 of the cavity 40 of the sleeve portion 30 is at least about 5% undersized of the first diameter Dlof the mounting post 14. In some embodiments, the fourth diameter D4 of the cavity 40 of the sleeve portion 30 is within the range of about 5% to about 20% undersized of the first diameter Dlof the mounting post 14. In some embodiments, the fourth diameter D4 of the cavity 40 of the sleeve portion 30 is about 10% undersized of the first diameter D1 of the mounting post 14. For example, in embodiments wherein the first diameter D1 of the connecting portion 22 (e.g., cylindrical connecting portion 22) of the mounting post 14 of the mount 10 is about 8 mm, the fourth diameter D4 of the cavity 40 of the sleeve portion 30 may be about 7.1 mm.

As shown in FIGS. 7 and 9, the sleeve portion 30 may extend over or about the non-threaded portions 28 and/or the threaded portion 26. For example, the mount 10 may be placed over at least a portion of the threaded portion 26 of the mounting post 14 and press fit in place. The undersize of the diameter D4 of the sleeve portion 30 of the mount 10 with respect to the first diameter D1 of the mounting post 14, and the flexible, elastic or elastomeric properties/nature of the sleeve portion 30/mount 10, may apply the compressive forces to the mounting post 14 to secure the mount 10 to the mounting post 14. For example, the elastomeric properties of the sleeve portion 30 may be configured to allow the sleeve potion 32 to stretch over the mounting post 14 providing a tight squeeze fit of the sleeve potion 32 onto mounting post 14 to lock or fix the mount 10 to the mounting post 14, as shown in FIGS. 7 and 9.

Figure 5A:
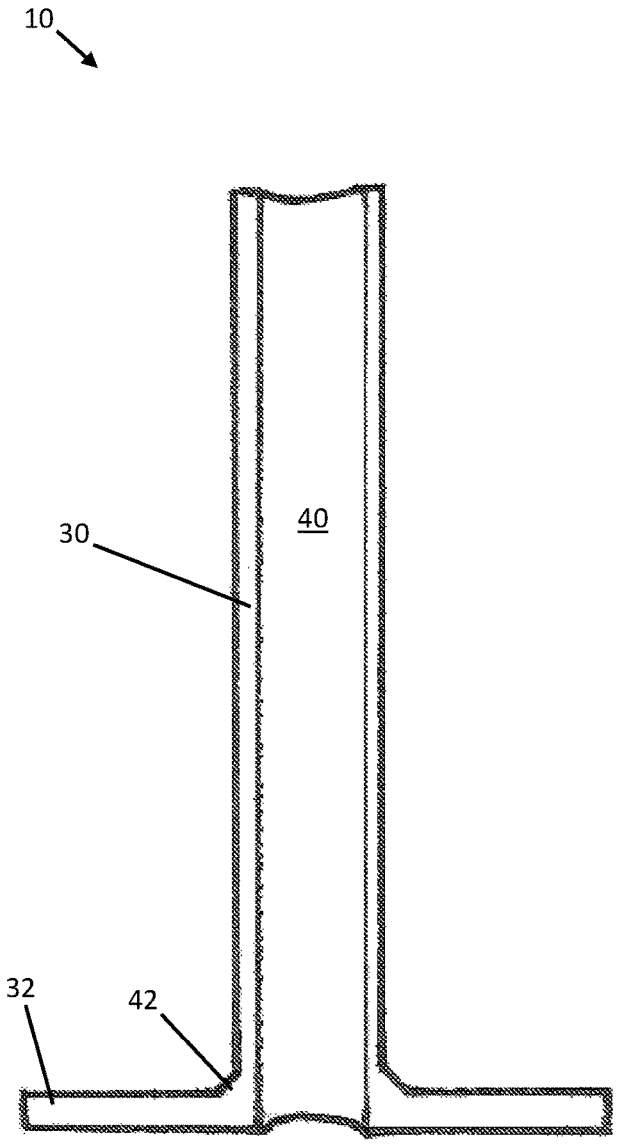
FIG. 5A is a cross-sectional view of the cymbal mount of FIG. 3.
Figure 5B:
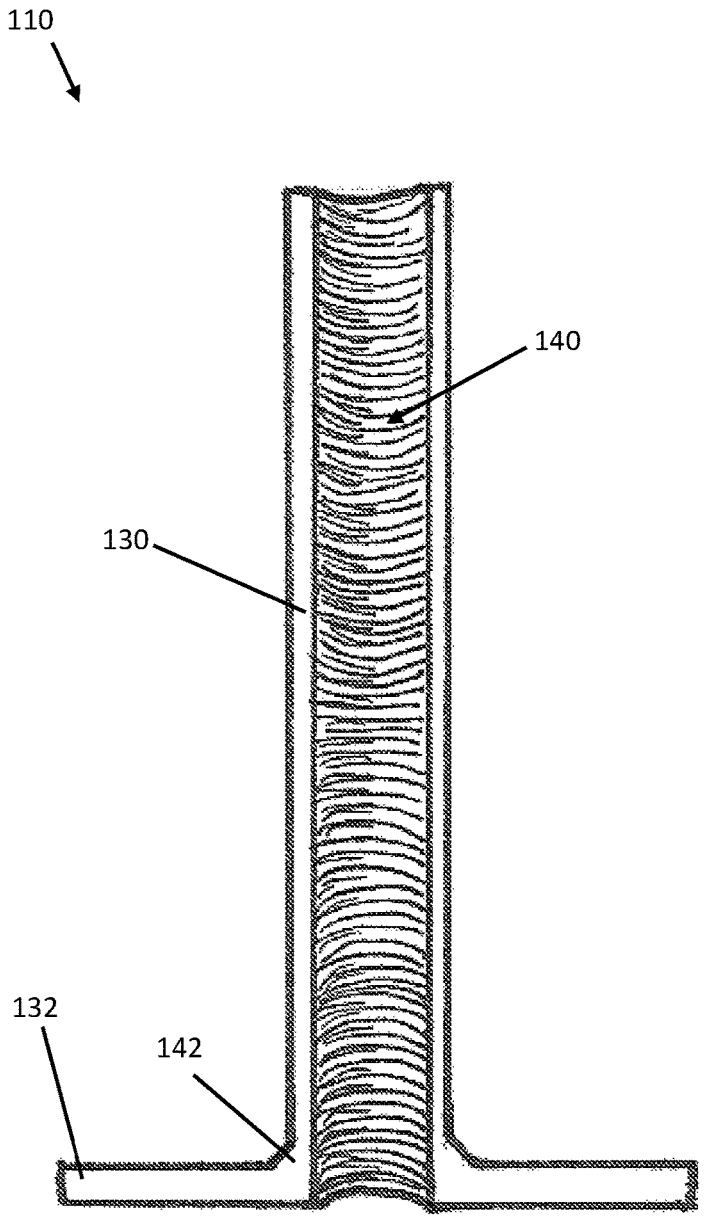
FIG. 5B is a cross-sectional view of another exemplary cymbal mount of an exemplary mount cymbal mounting apparatus according to the present disclosure.
Figure 6:
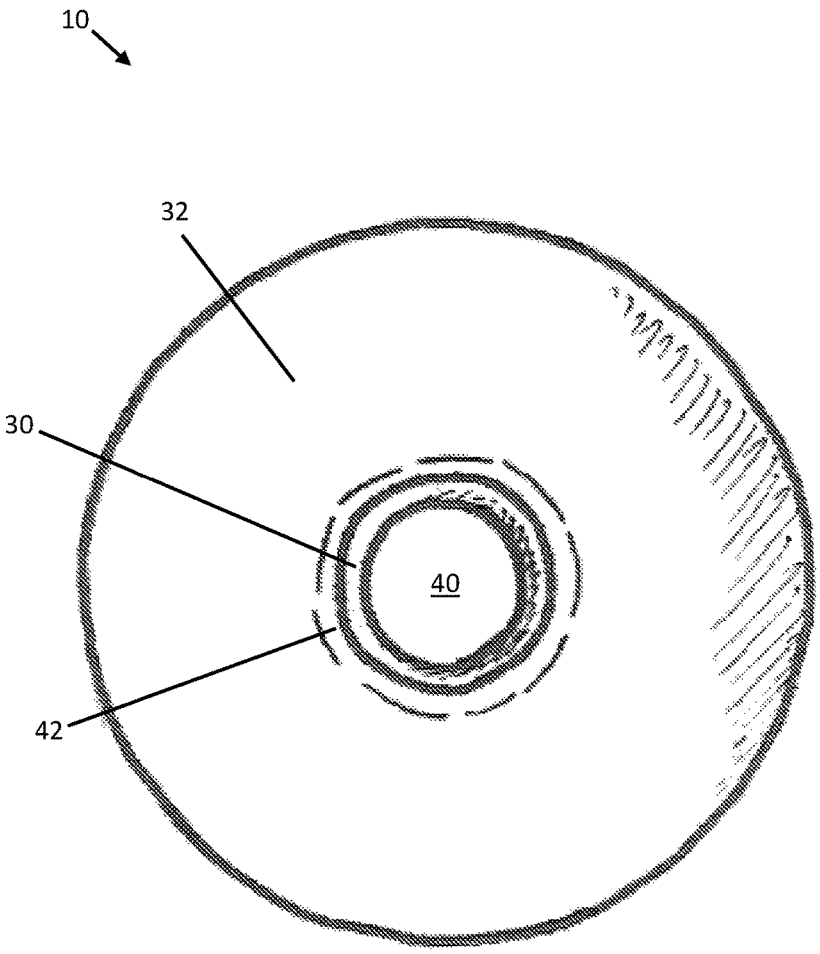
FIG. 6 is a top view of the cymbal mount of FIG. 3.

As shown in FIG, 5A, in some embodiments the interior surface of the sleeve portion 30 of the mount 10 that defines the cavity 40 may be entirely or at least partially non-threaded such that they define or include a substantially smooth wall surface. However, in alternative embodiment of a cymbal mount 110, as shown in FIG. 5B, the sleeve portion 132 that defines the cavity 140 may be entirely or at least partially threaded such that they define or include an internally threaded wall surface. In such embodiments, the internal threads may engage the threaded portion 26 of the mounting post 14, which may aid in securely affixing the mount 10 to the post 14.

In some embodiments, the sleeve portion 30 of the mount 10 may be slid over the mounting post 14 until the sleeve portion 30 engages or abuts the shoulder portion 20, as shown in FIG. 7. However, the sleeve portion 30 of the mount 10 may be slid over the mounting post 14 to a positon where the sleeve portion 30 is spaced away from the shoulder portion 20. The sleeve portion 30 may define an axial length L2 that is at least one half the axial length L1 of the mounting post 14. In some embodiments, the length L2 of the sleeve portion 30 is greater than the first length L1 of the mounting post 14, as shown in FIGS. 7 and 9. In some embodiments, the length L2 of the sleeve portion 30/mount 10 may be about 2.5 inches.

In some embodiments, the length L2 of the sleeve portion 30/mount 10 may be configured such that when the mount 10 is installed on/over the mounting post 14 at least a portion of the sleeve portion 30 may extend past the free end 24 of the mounting post 14. For example, the length L2 of the sleeve portion 30/mount 10 may be configured such that when the mount 10 is installed on/over the mounting post 14 at least half way down the mounting post 14 to the shoulder portion 20 at least a portion of the sleeve portion 30 may extend past the free end 24 of the mounting post 14. However, the sleeve portion 30 may not extend past the free end 24 of the mounting post 14. For example, the sleeve portion 30 may extend to or even with the free end 24 of the mounting post 14. In other embodiments, the free end 24 of the mounting post 14 may extend past the sleeve portion 30. The length L2 of the sleeve portion 30/mount 10 may be purposefully designed to extend beyond the end of the free end 24 of the mounting post 14 to further prevent the cymbal 12 from dismounting during use and/or to protect drum sticks from striking the mounting post 14 and/or for appearance. The squeeze fit feature and the extended length feature may combine to prevent the cymbal 12 from dismounting from the mounting post 14 during use.

As shown in FIGS. 3-7, the cymbal mount 10 may include a chamfer or radius 42 extending between the sleeve portion 14 and the rim portion 16. The chamfer or radius 42 may provide support strength to the rim portion 18 for the support of a cymbal 12 on the rim portion 16 and/or to help prevent the sleeve portion 14 and the rim portion 16 from separating from each other.

As discussed above, the cymbal mount 10 may be formed of elastomer or be elastomeric. The cymbal mount 10 may entirely be elastomer or elastomeric. In some embodiments, the sleeve portion 30 and/or the rim portion 32 may be elastomer or be elastomeric. As noted above, the compressive force or press fit nature of the sleeve portion 32 to the mounting post 14 may be provided, at least in part, by the elastomer or elastomeric material. The cymbal mount 10 (e.g., the sleeve portion 30 and/or the rim portion 32) may be an elastomer, such as a polymer with viscoelasticity (having both viscosity and elasticity) and very weak intermolecular forces, generally having low Young's modulus and high failure strain. The elastomer or elastomeric material may be any of various elastic substances resembling rubber, for example. The elastomer or elastomeric material may be Shore A durometer or Shore D durometer material. The elastomer or elastomeric material may include high elongation and flexibility or elasticity, and avoid breaking or cracking during use. The elastomer or elastomeric material may be able to be stretched to many times its original length, and may be capable of bouncing back into its original shape without permanent deformation. In some embodiments, the elastomer or elastomeric material may be a thermoset elastomer or a thermoplastic elastomer, or a combination thereof. In some embodiments, the elastomer or elastomeric material may not be melt-able (e.g., passed directly into a gaseous state), may swell in the presence of certain solvents, may be generally insoluble, may be flexible and elastic, and/or include relatively lower creep resistance. Examples of elastomer or elastomeric materials include, but are not limited to, natural rubber, polyurethanes, polybutadiene, neoprene, and silicone.

As shown in FIGS. 1, 2, 8 and 9, the cymbal mount 10 may include be utilized with a washer 50 configured to be positioned on an upper surface of the support rim portion 32 and extend at least partially about the sleeve portion 30. The washer 50 may be placed onto the support rim portion 32 followed by the cymbal 12, which is quickly mounted by simply placing it over the support rim portion 32 and resting it on the washer 50, as shown in FIGS. 8 and 9. In some embodiments, the washer 50 may be relatively thick. In some embodiments, the washer 50 may be relatively soft and/or flexible. For example, in some embodiments the washer 50 may be softer and/or more flexible than the rim portion 32 and/or the sleeve portion 30. In some embodiments, the washer 50 may be formed of felt or another similar material. However, as discussed above, a washer 50 may not be utilized and a cymbal 12 may be positioned directly on the support rim portion 32. In such embodiments, the support rim portion 32 may be at least 3 mm thick, such as 6 mm thick.

Figure 10:
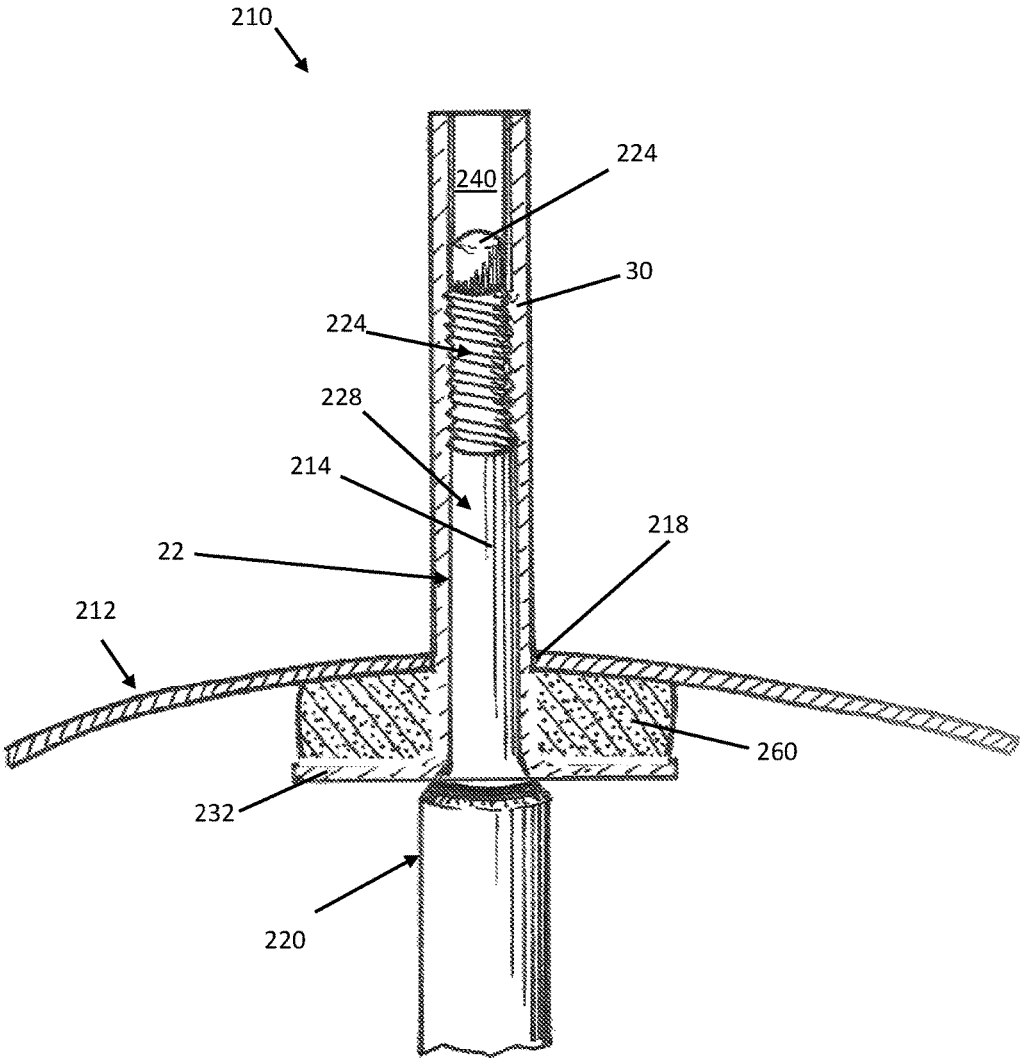
FIG. 10 is a cross-sectional view of another exemplary cymbal mounting apparatus installed on an exemplary mounting post mounting an exemplary cymbal according to the present disclosure.

In another alternative embodiment as shown in FIG. 10, the cymbal mount 210 may include a liner portion 260 extending from an upper portion of the rim portion 232 about at least a portion of the sleeve portion 230. In some embodiments, the liner portion 260 may be relatively soft and/or flexible. For example, in some embodiments the liner portion 260 may be softer and/or more flexible than the rim portion 232 and/or the sleeve portion 230. In some embodiments, the liner portion 260 may be formed of an elastomer or be elastomeric. As shown in FIG. 10, the liner portion 260 may be over-molded onto the rim portion 232 of the mount 210. In some embodiments, the liner portion 260 may be formed of a second softer elastomer over-molded onto a first elastomer of the rim portion 232 and/or the sleeve portion 230 of the mount 210. In this way, the mount 2210 and the liner portion 260 may be combined into a single finished molded component, as shown in FIG. 10. As also shown in FIG. 10, a cymbal 212 may be placed over the liner portion 260 and may rest upon, or be directly supported by, the liner portion 260. The relatively soft liner portion 260 may allow the cymbal 212 to rest comfortably on the rim portion 232 in the same manner as the washer 250, but be an integral part of the mount 210 and remain affixed to the mounting post 214 at all times.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed compositions or methods.

Any and all publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present disclosure have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the present disclosure.

The invention claimed is:

1. A cymbal mounting apparatus for mounting a cymbal to a mounting post of a cymbal stand, comprising:

a cymbal mount comprising:

an elongated flexible sleeve portion defining an inner cavity with a second diameter that is less than a first diameter of the mounting post of the cymbal stand such that the sleeve portion applies a compressive force to the mounting post when installed thereon; and a cymbal support rim portion extending outwardly from the sleeve portion.

2. The cymbal mounting apparatus of claim 1, wherein the sleeve portion and the rim portion are integral.

3. The cymbal mounting apparatus of claim 1, wherein the cymbal mount is elastomeric.

4. The cymbal mounting apparatus of claim 1, wherein the mounting post and the cavity of the sleeve portion are cylindrical, and wherein the cavity extends axially through the sleeve portion.

5. The cymbal mounting apparatus of claim 1, wherein the sleeve portion is cylindrical, and wherein the rim portion extends circumferentially about and radially outwardly from the sleeve portion.

6. The cymbal mounting apparatus of claim 1, wherein the rim portion defines a third diameter of about 1.5 inches.

7. The cymbal mounting apparatus of claim 1, wherein the cavity of the sleeve portion is non-threaded.

8. The cymbal mounting apparatus of claim 1, wherein at least a portion of the cavity of the sleeve portion is threaded.

9. The cymbal mounting apparatus of claim 1, wherein the second diameter of the cavity of the sleeve portion is about 10% undersized of the first diameter of the mounting post.

10. The cymbal mounting apparatus of claim 1, wherein the second diameter of the cavity of the sleeve portion is about 7.1 mm.

11. The cymbal mounting apparatus of claim 1, wherein the mounting post defines a first length extending between a shoulder portion and a free end thereof, and wherein the sleeve portion defines a second length that is at least one half the first length.

12. The cymbal mounting apparatus of claim 11, wherein the second length of the sleeve portion is greater than the first length of the mounting post.

13. The cymbal mounting apparatus of claim 1, wherein the sleeve portion defines an axial length of about 2.5 inches.

14. The cymbal mounting apparatus of claim 1, wherein the cymbal defines a mounting aperture of a fourth diameter, and wherein the sleeve portion is cylindrical and the exterior surface thereof defines a fifth diameter that is less than the fourth diameter.

15. The cymbal mounting apparatus of claim 1, wherein the sleeve portion is cylindrical and the exterior surface thereof defines a diameter of about 10 mm.

16. The cymbal mounting apparatus of claim 1, further comprising a washer configured to be positioned on an upper surface of the support rim and extend at least partially about the sleeve portion.

17. The cymbal mounting apparatus of claim 1, further comprising a liner portion extending from an upper portion of the rim portion about at least a portion of the sleeve portion, wherein the liner portion is more flexible than at least the rim portion.

18. A cymbal stand for supporting a cymbal, comprising:

a support arm including a mounting post defining a free end and a first diameter; and a cymbal mount comprising:

an elongated flexible sleeve portion defining an inner cavity with a second diameter that is less than the first diameter of the mounting post such that the sleeve portion applies a compressive force to the mounting post; and a cymbal support rim portion extending outwardly from the sleeve portion.

19. The cymbal mounting apparatus of claim 18, wherein the cymbal mount is of one-piece construction.

20. The cymbal mounting apparatus of claim 18, wherein the sleeve portion of the cymbal mount extends past the free end of the mounting post.

* * * * *